US007389816B2

(12) United States Patent
Cognata

(10) Patent No.: US 7,389,816 B2
(45) Date of Patent: Jun. 24, 2008

(54) THREE PHASE DOWNHOLE SEPARATOR PROCESS

(76) Inventor: Louis John Cognata, 15002 Lakeview Dr., Baytown, TX (US) 77520

( * ) Notice: Subject to any disclaimer, the term of this patent is extended or adjusted under 35 U.S.C. 154(b) by 0 days.

(21) Appl. No.: 11/825,369

(22) Filed: Jul. 6, 2007

(65) Prior Publication Data

US 2007/0251689 A1 Nov. 1, 2007

Related U.S. Application Data

(63) Continuation of application No. 11/140,305, filed on May 31, 2005, now Pat. No. 7,255,167.

(60) Provisional application No. 60/598,471, filed on Aug. 3, 2004.

(51) Int. Cl.
*E21B 43/38* (2006.01)
*E21B 43/40* (2006.01)

(52) U.S. Cl. ..... 166/265; 166/105.5; 166/106

(58) Field of Classification Search ..... 166/265, 166/105, 106, 369, 370, 105.5
See application file for complete search history.

(56) References Cited

U.S. PATENT DOCUMENTS

| | | | | |
|---|---|---|---|---|
| 5,979,559 | A | 11/1999 | Kennedy | 166/369 |
| 6,033,567 | A | 3/2000 | Lee et al. | 166/265 |
| 6,138,758 | A | 10/2000 | Shaw et al. | 166/265 |
| 6,755,978 | B2 | 6/2004 | Oddie | 210/747 |

*Primary Examiner*—Giovanna C Wright
(74) *Attorney, Agent, or Firm*—Jackson Walker L.L.P.

(57) ABSTRACT

Three Phase Downhole Separator Process (TPDSP) is a process which results in the separation of all three phases, (1) oil, (2) gas, and (3) water, at the downhole location in the well bore, water disposal injection downhole, and oil and gas production uphole.

19 Claims, 1 Drawing Sheet

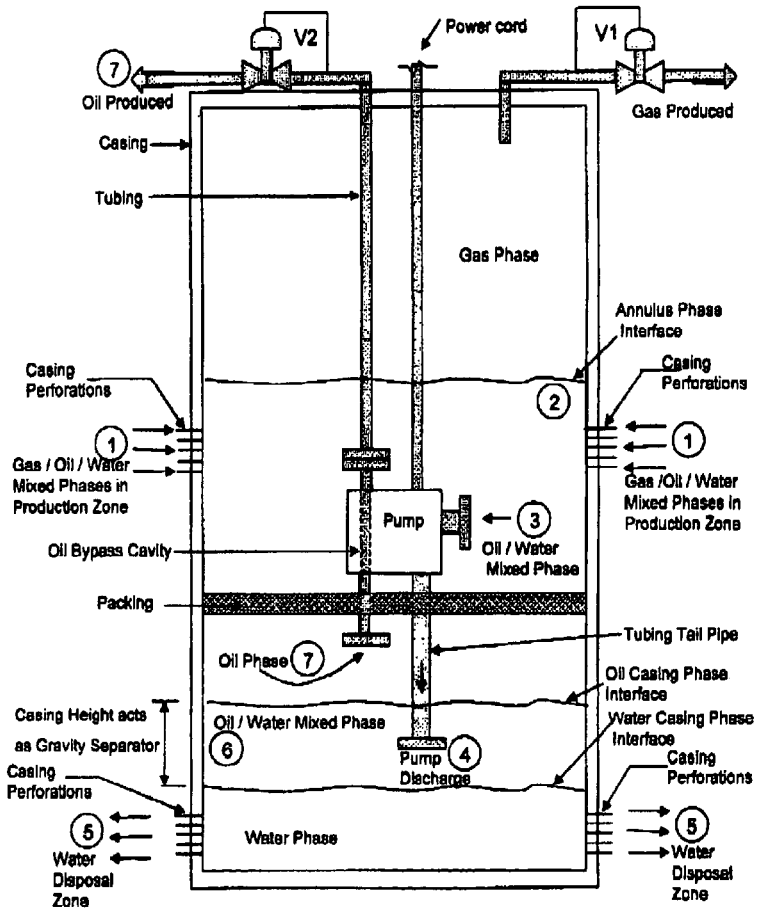

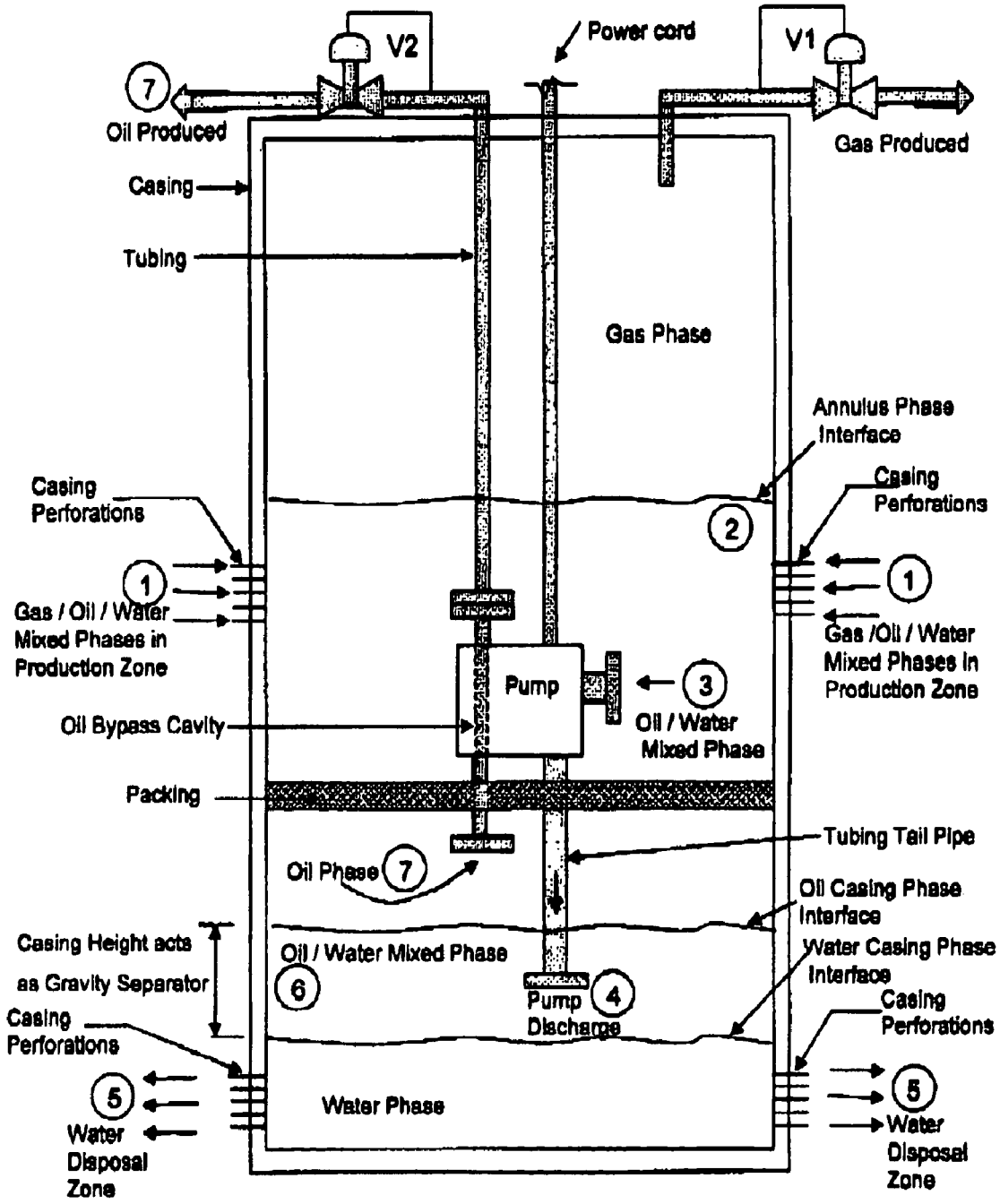
V2
Power cord
V1
7
Oil Produced
Gas Produced
Casing
Tubing
Gas Phase
Annulus Phase Interface
Casing Perforations
Casing Perforations
2
1
1
Gas / Oil / Water Mixed Phases in Production Zone
Gas /Oil / Water Mixed Phases in Production Zone
Pump
3
Oil / Water Mixed Phase
Oil Bypass Cavity
Packing
Tubing Tail Pipe
Oil Phase
7
Oil Casing Phase Interface
Casing Height acts as Gravity Separator
Oil / Water Mixed Phase
6
Water Casing Phase Interface
Pump Discharge
4
Casing Perforations
Casing Perforations
5
Water Phase
5
Water Disposal Zone
Water Disposal Zone

THREE PHASE DOWNHOLE SEPARATOR PROCESS

CROSS-REFERENCE TO RELATED APPLICATIONS

This patent application is a continuation of U.S. patent application Ser. No. 11/140,305, filed on May 31, 2005, now U.S. Pat. No. 7,255,167 which claims priority to U.S. Provisional Patent Application Ser. No. 60/598,471, filed on Aug. 3, 2004.

The field of endeavor is the Oil and Gas Production Industry. Reference Downhole Separation Technology Performance: Relationship to Geologic Conditions prepared for U.S. Department of Energy National Energy Technology Laboratory Under Contract W-31-109-Eng-38, Prepared-by John A. Vell and John J. Quinn Argonne National Laboratory November 2004. This reference provides no method of separating three phases downhole.

BRIEF SUMMARY OF THE INVENTION

This invention provides the process method of separating three phases downhole: oil, water, and gas.

BRIEF DESCRIPTION OF THE DRAWING

FIG. 1 entitled "Three Phase Downhole Separator Process-ESP," shows the process wherein oil, gas, and water are separated downhole with electric submersible pump (ESP). Other types of pumps may also utilize Three Phase Downhole Separator Process.

DETAILED DESCRIPTION OF THE INVENTION

The Three Phase Downhole Separator Process (TPDSP) is a PROCESS which results in the separation of all three phases, ie, (1) oil, (2) gas, and (3) water, at the downhole location in the well bore, often one mile below the surface of the earth. TPDSP utilizes the four types of published standard oil industry Down Hole Gas Water Separation (DGWS) technology, (A) Electric Submersible Pumps (ESPs) (B) Modified Plunger Rod Pumps (MPRPs) (C) Bypass Tools and (D) Progressive Cavity Pumps. Each of these four published technologies are two-phase separation technologies, separating the gas phase from the water phase only. TPDSP improves over the published technologies because the published technologies. provide only two phase downhole separation.

The TPDSP process converts each of the four published DGWS technologies into three-phase separator technologies. TPPSP (1) produces oil as a separate production stream uphole (2) produces gas as a separate production stream uphole and (3) injects water to the disposal zone downhole. TPDSP is not specific or limited to any one of the four published DGWS technologies nor is TPDSP based upon any one company's technology.

The TPDSP invention is a PROCESS patent, not a machine patent nor a manufacture patent nor composition of matter patent. It is a PROCESS patent because the invention provides for flow streams which are arranged differently than any previous patent or commercial idea, resulting in the separation of all three phases, ie, (1) oil, (2) gas, and (3) water at the downhole location. The category of the patent is UTILITY, not design nor plant.

Description of drawing which shows conversion of the DGWS Technology (A) Electric Submersible Pump: Refer to the drawing entitled, "THREE PHASE DOWNHOLE SEPARATOR PROCESS—ESP". This drawing shows conversion of the published DGWS technology (A) Electric Submersible Pump (ESP) into TPDSP. The PROCESS is described as the following streams:

| Stream Number | Stream Description |
|---|---|
| 1. | Gas, Oil, and Water flow from the formation through the casing perforations and into the casing annulus. |
| 2. | Gas bubbles upward thru the liquid oil and water mixture, and gas flows up the annulus to be produced at the surface. V1 is a back pressure regulator which is set at the proper pressure to assure that the Annulus Phase Interface location (API) stays above the ESP Pump Suction location. |
| 3. | Water/Oil mixture flows into the ESP Pump Suction as a liquid mixture. |
| 4. | High pressure liquid water/oil mixture flows downward out the Tubing Tail Pine at the bottom ESP Pump Discharge. |
| 5. | High pressure liquid water continues flowing downward in the casing because water is more dense than oil. When the dense water falls and reaches the Water Casing Phase Interface (WCPI), the water is "pure" without oil bubbles. The liquid water flows into the Disposal Zone Casing Perforations and enters the disposal zone. [The Disposal Zone Casing Perforations must be sized small enough to provide a high enough back pressure to produce the oil to the surface, large enough to flow all the disposal water into the disposal zone, and placed at low enough depth to allow enough height for gravity separation of the oil and water phases.] |
| 6. | High pressure liquid oil "bubbles" upward thru the high pressure liquid water. The "bubbles" of oil become more and more numerous as they rise until they finally reach the Oil Casing Phase Interface (OCPI). Above OCPI is pure liquid oil. |
| 7. | High pressure oil flows thru the ESP pump Oil Bypass Cavity, up into the tubing, and to the surface thru V2. V2 is a back pressure regulator which is set at the proper pressure to assure that the OCPI stays below the Oil Bypass Cavity in the ESP. |

Although the drawing shows an electric submersible pump (ESP), the ESP on the drawing can be replaced by any one of the four published Down Hole Gas Water Separation (DGWS) technologies, (A) Electric Submersible Pumps (ESPs) (B) Modified Plunger Rod Pumps (MPRPs) (C) Bypass Tools and (D) Progressive Cavity Pumps. The result is TPDSP, a PROCESS which (1) produces oil as a separate production stream uphole (2) produces gas as a separate production stream uphole and (3) injects water to the disposal zone downhole.

TPDSP Applicability to Unpublished and Future DGWS Technology: The TPDSP Process is applicable to the four published DGWS technologies, and in addition is applicable to unpublished and future DGWS technologies. For example, the downhole jet pump technology is a candidate for future DGWS technology. If the jet pump becomes a DGWS technology, this TPDSP Process could convert the DGWS jet pump technology to (1) produce oil as a separate production stream uphole (2) produce gas as a separate production stream uphole and (3) inject water to the disposal zone downhole.

The TPDSP Process applied to the four published DGWS technologies and to unpublished future DGWS technologies provides three phase separation downhole, water injection downhole, and both gas and oil production uphole.

What is claimed is:

1. A process for downhole separation of water, oil, and gas within a well bore in a formation, the well bore having a casing and the well bore extending from a surface, comprising:

providing a packing within the casing so as to provide substantial fluid isolation between a first vertical length of the casing and a second vertical length of the casing;

allowing a mixture from the formation to enter the first vertical length of the casing;

allowing the mixture to form a gas phase and a first liquid mixture in the first vertical length wherein the gas phase comprises a gas and the first liquid mixture comprises a liquid;

providing a pump, the pump having a pump intake in the first vertical length;

providing a pump discharge tubing from the pump that extends through the packing to the second vertical length;

pumping the first liquid mixture from the first vertical length through the pump discharge tubing to the second vertical length so as to form a second liquid mixture in the second vertical length;

allowing the second liquid mixture to form an oil phase and a water phase in the second vertical length;

providing an oil tubing that extends from the oil phase to the surface to allow for production of the oil;

regulating an oil flow from the oil phase to the surface so as to maintain an oil phase level;

allowing water from the water phase to be discharged outside of the casing to a water disposal zone in the formation;

providing a gas piping from the gas phase in the first vertical length to the surface to allow for the production of the gas to the surface; and regulating a gas flow from the gas phase in the first vertical length to the surface so as to maintain a back pressure in the first vertical length.

2. The method of claim 1 wherein the first vertical length is above the packing and wherein the second vertical length is below the packing.

3. The method of claim 2 further comprising perforating the casing in the second vertical length to allow the water to be discharged to the water disposal zone.

4. The method of claim 3 wherein the pump further comprises an oil-bypass cavity in the pump to allow the oil tubing to pass through the pump from the second vertical length to the surface.

5. The method of claim 3 wherein the pump is an electric submersible pump, a modified plunger rod pump, or a progressive cavity pump.

6. The method of claim 3 further comprising providing a gas valve inline with the gas piping and regulating the gas flow with the gas valve so as to maintain the back pressure.

7. The method of claim 3 further comprising providing an oil valve inline with the oil tubing and regulating the flow of oil with the oil valve.

8. The method of claim 1 further comprising perforating the casing in the first vertical length to allow the mixture to flow from the formation into the casing.

9. The method of claim 1 further comprising regulating an oil flow from the oil phase to the surface so as to maintain the oil phase level below an inlet of the oil tubing.

10. A downhole three phase separation process within a well bore in a formation comprising:

providing a casing extending through the well bore, the well bore extending from a surface;

providing a packing within the casing so as to provide substantial fluid isolation between a first vertical length of the casing above the packing and a second vertical length of the casing below the packing;

providing an oil production tubing from the second vertical length that extends to the surface so as to form an annulus between the casing and the oil production tubing;

allowing a mixture from the formation to enter the casing in the annulus of the first vertical length;

allowing the mixture to form a gas phase and a first liquid mixture in the annulus of the first vertical length wherein the gas phase comprises a gas and the first liquid mixture comprises a liquid and wherein a gas-liquid interface is formed between the gas phase and the first liquid mixture;

providing a pump, the pump having a pump intake in the annulus of the first vertical length;

providing a pump discharge tubing from the pump that extends through the packing to the second vertical length;

pumping the first liquid mixture from the annulus of the first vertical length through the pump discharge tubing to the second vertical length so as to form a second liquid mixture in the second vertical length;

allowing the second liquid mixture to form an oil phase and a water phase in the second vertical length and wherein a first interface is formed between the oil phase and the second liquid mixture and a second interface is formed between the second liquid mixture and the water phase;

regulating an oil flow from the oil phase to the surface so as to maintain the first interface;

allowing water from the water phase to be discharged outside of the casing to a water disposal zone in the formation;

providing a gas piping from the gas phase in the annulus of the first vertical length to the surface to allow for the production of the gas to the surface; and regulating a gas flow from the gas phase in the first vertical length to the surface so as to maintain the gas-liquid interface above the pump intake.

11. The method of claim 10 further comprising:

perforating the casing in the first vertical length to allow the mixture to flow from the formation into the annulus of the casing;

perforating the casing in the second vertical length to allow the water to be discharged to the water disposal zone in the formation;

providing a gas valve inline with the gas piping and regulating the gas flow with the gas valve so as to maintain the back pressure; and providing an oil valve inline with the oil tubing and regulating the flow of oil with the oil valve.

12. The method of claim 10 further comprising regulating an oil flow from the oil phase to the surface so as to maintain the first interface above an outlet of the pump discharge tubing.

13. A three phase separator device in a well bore comprising:

a casing extending through the well bore, the well bore extending from a surface;

a packing within the casing capable of providing substantial fluid isolation between a first vertical length of the casing above the packing and a second vertical length of the casing below the packing;

an oil production tubing from the second vertical length that extends to the surface so as to form an annulus between the casing and the oil production tubing;

an oil valve inline with the oil production tubing capable of regulating a flow of oil through the oil production tubing;

a pump having a pump intake in the annulus of the first vertical length and a pump discharge tubing from the pump that extends through the packing to the second vertical length;

a gas piping from the annulus of the first vertical length to the surface to allow for the production of a gas to the surface; and a gas valve inline with the gas piping capable of regulating a flow of gas through the gas piping.

14. The three phase separator device of claim 13 wherein the casing further comprises perforations in the first vertical length of the casing to allow a mixture to flow from the formation into the annulus of the first vertical length of the casing.

15. The three phase separator device of claim 14 wherein the casing further comprises perforations in the casing of the second vertical length to allow the water to be discharged to the water disposal zone.

16. The three phase separator device of claim 15 wherein the pump further comprises an oil-bypass cavity in the pump to allow the oil production tubing to pass through the pump from the second vertical length to the surface.

17. The three phase separator device of claim 15 wherein the pump is an electric submersible pump, a modified plunger rod pump, or a progressive cavity pump.

18. The three phase separator device of claim 15 further comprising providing a gas valve inline with the gas piping and regulating the gas flow with the gas valve so as to maintain the back pressure.

19. The three phase separator device of claim 15 further comprising providing an oil valve inline with the oil production tubing and regulating the flow of oil with the oil valve.

* * * * *